US010734771B2

(12) United States Patent
Underwood

(10) Patent No.: US 10,734,771 B2
(45) Date of Patent: Aug. 4, 2020

(54) FOUR-TERMINAL HEADPHONE SOCKET WITH TWO ELECTRICALLY-CONNECTED TERMINALS TO ENSURE RELIABLE AUDIO WITH DIFFERENT PLUGS

(71) Applicant: IFPL Group Limited, Newport, Isle of Wight (GB)

(72) Inventor: Geoffrey Paul Underwood, Newport (GB)

(73) Assignee: IFPL Group Limited, Newport, Isle of Wight (GB)

( * ) Notice: Subject to any disclaimer, the term of this patent is extended or adjusted under 35 U.S.C. 154(b) by 202 days.

(21) Appl. No.: 15/128,795

(22) PCT Filed: Mar. 25, 2015

(86) PCT No.: PCT/GB2015/050886
§ 371 (c)(1),
(2) Date: Sep. 23, 2016

(87) PCT Pub. No.: WO2015/145146
PCT Pub. Date: Oct. 1, 2015

(65) Prior Publication Data

US 2017/0063004 A1 Mar. 2, 2017

(30) Foreign Application Priority Data

Mar. 25, 2014 (GB) ..... 1405326.8

(51) Int. Cl.
*H01R 24/58* (2011.01)
*H01R 27/00* (2006.01)
*H01R 107/00* (2006.01)

(52) U.S. Cl.
CPC ..... *H01R 24/58* (2013.01); *H01R 27/00* (2013.01); *H01R 2107/00* (2013.01)

(58) Field of Classification Search
CPC ..... H01R 24/58; H01R 27/00; H01R 2107/00
(Continued)

(56) References Cited

U.S. PATENT DOCUMENTS 1,978,076 A 10/1934 Cassedy, Jr.
2,135,267 A 11/1938 Alden
(Continued)

FOREIGN PATENT DOCUMENTS

CN 101783986 A 7/2010
CN 102035911 A 4/2011
(Continued)

OTHER PUBLICATIONS

"Search Report" United Kingdom Intellectual Property Office, IFPL Group Limited, United Kingdom Patent Application No. GB 1405326.8, dated Sep. 17, 2014 (1 page).
(Continued)

*Primary Examiner* — Amy Cohen Johnson
*Assistant Examiner* — Paul D Baillargeon
(74) *Attorney, Agent, or Firm* — Tillman Wright, PLLC; James D. Wright; David R. Higgins

(57) ABSTRACT

A socket (2) for a headphone set, comprising: four terminals (5, 6, 7, 8), arranged to contact with terminal contacts (11*a*, 12*a*, 13, 14*a*) of a plug of a headphone set, the terminals longitudinally spaced within a plug-receiving space of the socket, wherein two of the adjacent terminals are electrically connected together.

9 Claims, 1 Drawing Sheet

(58) Field of Classification Search
USPC ..... 439/668
See application file for complete search history.

(56) References Cited

U.S. PATENT DOCUMENTS

| | | | | |
|---|---|---|---|---|
| 2,297,188 | A | 9/1942 | Joyce | |
| 3,383,588 | A | 5/1968 | Stoll et al. | |
| 3,432,795 | A | 3/1969 | Jayne | |
| 3,569,908 | A | 3/1971 | Appleton | |
| 3,933,404 | A | 1/1976 | Oehlerking et al. | |
| 4,034,172 | A | 7/1977 | Glover et al. | |
| 4,084,875 | A | 4/1978 | Yamamoto | |
| 4,118,690 | A | 10/1978 | Paynton | |
| 4,124,877 | A | 11/1978 | Vollenweider | |
| 4,483,575 | A | 11/1984 | Kruger et al. | |
| 4,529,861 | A | 7/1985 | Blanton | |
| 4,628,392 | A | 12/1986 | Didier | |
| 4,927,382 | A | 5/1990 | Huber | |
| 5,174,787 | A | 12/1992 | Shirai et al. | |
| 5,176,528 | A | 1/1993 | Fry et al. | |
| 5,346,406 | A | 9/1994 | Hoffman et al. | |
| 5,384,492 | A | 1/1995 | Carlson et al. | |
| 5,476,386 | A | 12/1995 | Booth | |
| 5,591,035 | A | 1/1997 | Burkholder et al. | |
| 5,655,916 | A | 8/1997 | Hayashi | |
| 5,873,737 | A | 2/1999 | Hashizawa et al. | |
| 5,909,065 | A | 6/1999 | Jones et al. | |
| 6,109,797 | A * | 8/2000 | Nagura | G02B 6/4292 385/88 |
| 6,338,657 | B1 | 1/2002 | Harper et al. | |
| 6,392,901 | B1 | 5/2002 | Colver et al. | |
| 6,447,309 | B1 | 9/2002 | Ko et al. | |
| 6,494,734 | B1 | 12/2002 | Shuey | |
| 6,683,273 | B2 | 1/2004 | Conway et al. | |
| 7,241,179 | B2 * | 7/2007 | Chennakeshu | H01R 13/35 439/668 |
| 7,604,505 | B2 | 10/2009 | Zayas | |
| 7,666,027 | B2 | 2/2010 | Takehara | |
| 7,736,197 | B2 | 6/2010 | Takeda | |
| 7,740,498 | B1 | 6/2010 | Orsley | |
| 7,789,714 | B2 | 9/2010 | Liu | |
| 7,988,494 | B2 | 8/2011 | Lee | |
| 8,152,558 | B2 | 4/2012 | Broeksteeg et al. | |
| 8,362,654 | B2 * | 1/2013 | Inha | H03K 17/687 307/112 |
| 8,672,696 | B2 | 3/2014 | Sakurai | |
| 8,866,485 | B1 | 10/2014 | Lacey et al. | |
| 9,300,082 | B2 | 3/2016 | Underwood | |
| 2007/0259536 | A1 | 11/2007 | Long et al. | |
| 2008/0164994 | A1 | 7/2008 | Johnson et al. | |
| 2009/0130910 | A1 | 5/2009 | Inha et al. | |
| 2009/0179768 | A1 | 7/2009 | Sander et al. | |
| 2011/0005828 | A1 * | 1/2011 | Ye | H04B 10/801 174/70 R |
| 2014/0017955 | A1 | 1/2014 | Lo et al. | |
| 2015/0093918 | A1 | 4/2015 | Underwood | |

FOREIGN PATENT DOCUMENTS

| | | | |
|---|---|---|---|
| EP | 2658222 | A1 | 10/2013 |
| WO | 2015145146 | A1 | 10/2015 |

OTHER PUBLICATIONS

"International Preliminary Report on Patentability" and "Written Opinion of the International Bureau of WIPO" in IFPL Group Limited, International Patent Application Serial No. PCT/GB2015/050886, dated Oct. 6, 2016, (6 pages).

"International Search Report" and "Written Opinion of the International Search Authority" (European Patent Office) in IFPL Group Ltd., International Patent Application Serial No. PCT/GB2015/050886, dated May 20, 2015, 10 pages.

* cited by examiner

FOUR-TERMINAL HEADPHONE SOCKET WITH TWO ELECTRICALLY-CONNECTED TERMINALS TO ENSURE RELIABLE AUDIO WITH DIFFERENT PLUGS

CROSS REFERENCE TO RELATED APPLICATIONS

This application is the U.S. national stage application under 35 U.S.C. § 371 of International Application No. PCT/GB2015/050886, filed Mar. 25, 2015 and designating the U.S., which published as WO 2015/145146 A1 on Oct. 1, 2015, and which claims the benefit of United Kingdom Patent Application No. GB 1405326.8, filed Mar. 25, 2014. Each of the foregoing patent applications and patent application publications is expressly incorporated by reference herein in its entirety.

TECHNICAL FIELD

The present invention relates to sockets for headphone sets.

BACKGROUND

Development of mobile phone and other portable device technology has meant that many of these devices are provided with a 3.5 mm (diameter) connector which allows them to connect with a combined headphone and microphone set. Typically these comprise a speaker for each ear and a microphone, usually provided as a medallion. The connectors, or sockets, (of the mobile phone/portable device technology) for such sets are provided with four terminals, as is the set's plug/pin.

An issue arises that different manufacturers configure the contacts of the plug differently. Manufacturer A may have the microphone contact as an inner terminal whereas manufacturer B may have the microphone on the outer terminal. In an aircraft seat with inflight entertainment, passengers often chose to listen to the audio provided using their personal headphones, rather than the ones provided by the airline. Sometimes the passenger will desire to use his/her combined headphone/microphone set which has a four contact plug. Because the audio socket module in the aircraft is normally configured with only three terminals, use of a plug with four contacts creates an incompatibility that results in loss of either left or right audio when a combined headphone/microphone is connected.

We have devised an improved socket for headphone sets.

SUMMARY

According to the invention there is provided a socket for headphone sets, comprising: four terminals, arranged to contact with terminal contacts of a plug of audio headphones, the terminals longitudinally spaced within a plug-receiving space of the socket, wherein the two of the adjacent terminals are electrically connected together.

The socket may be termed an audio jack, and may generally be thought of as an audio interface.

The interface may be a passenger audio interface for an aircraft, or other passenger transportation. Moreover, the audio interface may be used in any application in which many audio interfaces are provided, which, in addition to passenger transportation (such as planes, trains, waterborne vessels, buses and mass transportation), includes venues such as studios, theatres, conference centres, classrooms etc.

The headphone set may comprise one or more features described in the description and/or shown in the drawings.

BRIEF DESCRIPTION OF THE DRAWINGS

One embodiment of the invention will now be described, by way of example only, with reference to the following drawings in which.

DETAILED DESCRIPTION

Figure 1:
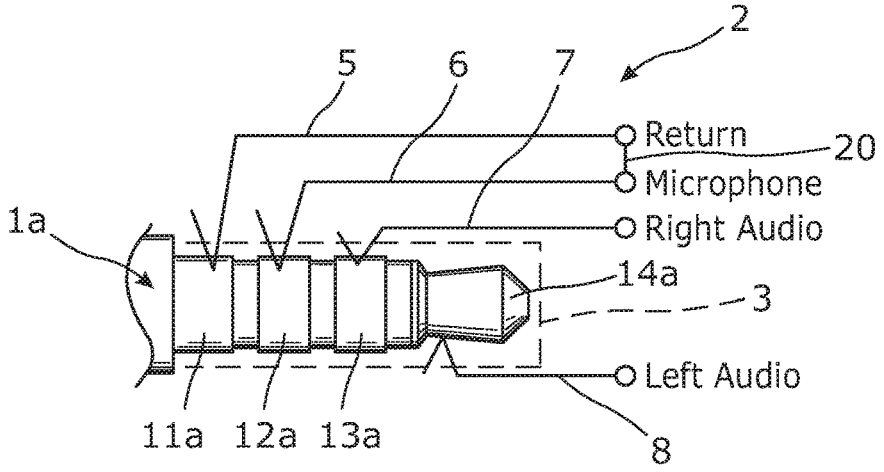
FIG. 1 is a schematic representation of an audio jack with a first type of headset plug inserted therein.
Figure 2:
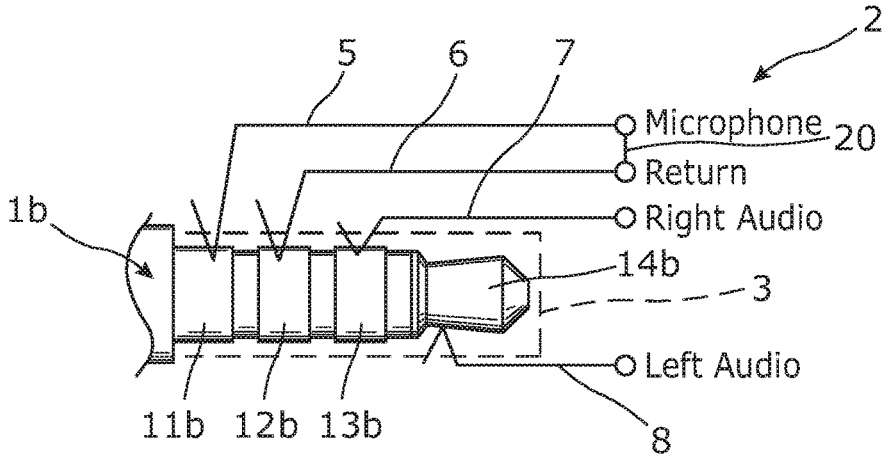
FIG. 2 is a schematic representation of the audio jack with a variant of the first type of headset plug therein.
Figure 3:
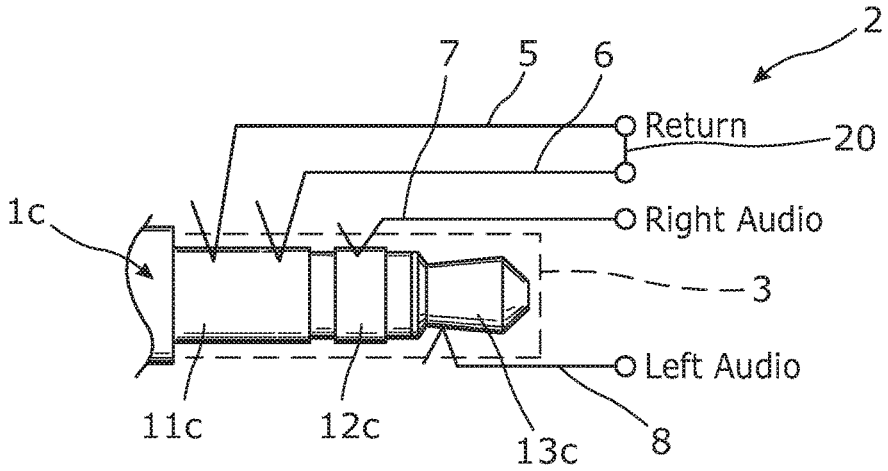
FIG. 3 is a schematic representation of the audio jack with a second type of the headset plug therein.

Reference is made to FIGS. 1, 2 and 3, which show a plug 1 of a headphone set inserted into an audio socket, or jack, 2. The jack 2 is provided with a plug-receiving space 3 which comprises an elongate space arranged to receive the plug. When inserted into the jack, the tip and sleeve contacts come into electrical contact with the terminals. As will be described below the jack 2 allows use of both a three and four contact pin to be used.

The jack 2 comprises four electrical terminals 5, 6, 7 and 8. Each contact is resiliently biased towards the plug-receiving space 3 of the jack, thereby ensuring that when a plug is inserted onto the jack that the contacts are deflected outwardly and providing a counter-force to maintain engagement with the contacts of the plug thereby ensuring an electrical conduction between the pin and the terminal.

Those portions of the terminals which engage with the pin are spaced along the length of the plug-receiving space 3. The positioning of the terminals within the space 3 is determined so as to be in register with a respective contact of the plug.

Comparing the plugs 1*a* and 1*b*, as is reflective of plugs produced by different manufacturers, the plug 1*a* has the sleeve contact 11*a* providing a ground return, which could be termed the innermost sleeve, whereas the plug 1*b* provides in innermost sleeve 11*b* as the microphone signal contact. It will be appreciated that the plugs 1*a* and 1*b* are connected to a headphone set which comprises left and right channel speakers, and a microphone. Such headphone sets are typically used with mobile phones, as well as other types of device, to allow the wearer to speak into the microphone, for example whilst making a phone call.

In the example illustrated, the pin 1*a* comprises three sleeve contacts 11*a*, 12*a*, 13*a* and a tip contact 14*a*. Those contacts are arranged to engage with terminals 5, 6, 7 and 8 respectively. Similarly, the sleeve contacts 11*b*, 12*b*, 13*b* and the tip contact 14*b* are arranged to engage with the terminals 5, 6, 7 and 8 respectively. Finally, the three contact plug 1*c*, comprises two sleeve contacts 11*c* and 12*c*, and a tip contact 13*c*, for which the contacts 11*c* and 12*c* are arranged to engage with the terminals 5 and 6, and the tip contact 13*c* is arranged to engage with the terminal 8.

In the context of passenger entertainment systems, for which the jack 2 is primarily but not exclusively, intended, the jack 2 allows passengers to use either the headphone sets with microphones having four contacts pin as well as headphone sets without microphones with three pin contacts.

The jack 2 is part of an audio interface of an 'at-seat' passenger entertainment system, with an interface being provided for each passenger, at or adjacent to each passenger's seat. When the user's headphone set is connected to the jack 2, passengers may select audio or visual content, such as music or the spoken word.

As can be seen in the Figures, the (end of the) terminals 5 and 6 are electrically connected together at 20. This provides a short between the two terminals. Both terminals are connected to a ground electrical potential thus, advantageously, regardless of whether a user inserts a plug of type 1*a* or of type 1*b*, the return terminal of either headphone be connected to ground. Further advantageously, if a plug 1*c*, of the 'non-microphone' headphone set type is inserted into the jack, the return sleeve contact 11*c* will engage with both of the terminals 5 and 6, thus correctly providing a ground connection for the headphone set.

The jack is perfectly compatible not only with different contact configurations of four contact headphone set plugs, but is also compatible with three contact plugs.

The invention claimed is:

1. A socket for a headphone set, comprising: four terminals, arranged to contact with terminal contacts of a plug of a headphone set, the terminals longitudinally spaced within a plug-receiving space of the socket, wherein two adjacent terminals are permanently electrically connected together by way of a shorting connection.

2. A socket for a headphone set, comprising: four terminals, arranged to contact with terminal contacts of a plug of a headphone set, the terminals longitudinally spaced within a plug-receiving space of the socket, wherein two adjacent terminals are electrically connected together by way of a shorting connection, in which the electrically-connected terminals are arranged to provide connection to a ground return contact of the plug and a microphone signal contact of the plug and in which the electrically-connected terminals include a first terminal arranged to provide connection to a ground return contact of the plug and a second terminal arranged to provide a microphone signal contact of the plug, and wherein the first terminal and the second terminal are permanently connected together.

3. The socket of claim 2 in which the electrically connected terminals are located towards a distal end of the plug-receiving space of the socket.

4. The socket of claim 3 in which the electrically connected terminals are located towards a plug receiving open end of the plug-receiving space.

5. The socket of claim 2 in which the other two of the four terminals are not electrically connected together, and are arranged to contact with left audio channel and right audio channel contacts of the plug.

6. The socket of claim 5 in which said other two terminals are adjacent to each other.

7. The socket of claim 2 in which the electrically connected terminals are arranged to be connected to ground.

8. The socket of claim 2 in which the two electrically connected terminals are shorted together by the shorting connection.

9. The socket of claim 8 in which each of the two electrically connected terminals includes a first end and a second end, wherein each of the two electrically connected terminals includes a contact at the first end thereof, and wherein the shorting connection connects the second ends, thereby providing a short between the two electrically connected terminals.

* * * * *